US010173314B1

(12) United States Patent
Lai

(10) Patent No.: US 10,173,314 B1
(45) Date of Patent: Jan. 8, 2019

(54) TOOL HANGER

(71) Applicant: Jin-Lan Lai, Taichung (TW)

(72) Inventor: Jin-Lan Lai, Taichung (TW)

( * ) Notice: Subject to any disclaimer, the term of this patent is extended or adjusted under 35 U.S.C. 154(b) by 0 days.

(21) Appl. No.: 15/713,231

(22) Filed: Sep. 22, 2017

(51) Int. Cl.
*A47F 5/00* (2006.01)
*A47F 7/00* (2006.01)
*B25H 3/04* (2006.01)

(52) U.S. Cl.
CPC ..... *B25H 3/04* (2013.01); *A47F 5/0006* (2013.01); *A47F 7/0007* (2013.01)

(58) Field of Classification Search
CPC ..... B25H 3/04; B25H 3/003; B25H 3/006; B25H 3/06; B25H 3/00; B25H 3/02; A47F 5/0006; A47F 7/0007; A47F 7/028; A47F 5/0846; A47F 5/0853; A47F 5/08
USPC ..... 211/70.6, 94.01, 69; 206/349, 372, 376, 206/378, 379
See application file for complete search history.

(56) References Cited

U.S. PATENT DOCUMENTS 4,226,394 A * 10/1980 Einhorn ..... A47J 47/16 24/716
4,353,465 A * 10/1982 Rado ..... B25H 3/06 206/378
4,768,660 A * 9/1988 Handler ..... A47F 5/0846 211/106.01
4,826,021 A * 5/1989 Burrell ..... B25B 13/56 211/70.6
5,535,881 A * 7/1996 Krivec ..... B25H 3/003 206/376
5,645,177 A * 7/1997 Lin ..... B25H 3/04 206/378
5,897,001 A * 4/1999 Dembicks ..... B25B 13/56 206/378
6,070,745 A * 6/2000 Dembicks ..... B25H 3/06 206/378
6,168,018 B1 * 1/2001 Ramsey ..... B25H 3/06 206/378
6,386,363 B1 * 5/2002 Huang ..... B25H 3/003 206/1.5
6,431,373 B1 * 8/2002 Blick ..... B25H 3/003 206/378
6,564,949 B1 * 5/2003 Saathoff ..... B25H 3/006 211/70.6
6,571,966 B1 * 6/2003 Hsiao ..... A47F 7/0028 206/379

(Continued)

*Primary Examiner* — Jennifer E. Novosad
(74) *Attorney, Agent, or Firm* — Muncy, Geissler, Olds & Lowe, P.C.

(57) ABSTRACT

A slot tool hanger is provided, including: a base, configured to be slidably assembled within a track slot and including a wide section and at least one narrow section in a first direction, the wide section defining a first length dimension in a second direction, each narrow section defining a second length dimension in the second direction, the base further including two end portions at opposite ends in the first direction, at least one of the two end portions including a resilient convex surface on the wide section and a compression structure corresponding to the resilient convex surface; a combination portion, disposed on the base; wherein the first length dimension is greater than the second length dimension and greater than the short side dimension, and the second length dimension is less than or equal to the short side dimension.

9 Claims, 5 Drawing Sheets

(56) References Cited

U.S. PATENT DOCUMENTS 7,490,727 B2 * 2/2009 Spiers ..... A47F 7/0028 211/70.6
7,717,278 B2 * 5/2010 Kao ..... B25H 3/04 206/349
8,066,130 B2 * 11/2011 Shaha ..... A47B 96/067 211/106.01
8,733,562 B2 * 5/2014 Kao ..... B25H 3/04 206/378
8,770,418 B2 * 7/2014 Ernst ..... B25H 3/04 211/69
9,186,790 B1 * 11/2015 Kao ..... B25H 3/06
9,522,467 B1 * 12/2016 Kao ..... A47F 7/0028
9,527,206 B1 * 12/2016 Hsieh ..... B25H 3/003
9,656,385 B1 * 5/2017 Kao ..... B25H 3/04
9,757,853 B2 * 9/2017 Su ..... B25H 3/04
9,956,681 B2 * 5/2018 Kao ..... B25H 3/003
2001/0001197 A1 * 5/2001 Ramsey ..... B25H 3/06 206/378
2004/0020880 A1 * 2/2004 Kao ..... A47F 7/024 211/70.6
2005/0221664 A1 * 10/2005 Winnard ..... B25H 3/003 439/510
2008/0000853 A1 * 1/2008 Huang ..... A47F 7/0028 211/70.6
2008/0302743 A1 * 12/2008 Chen ..... A47F 5/0006 211/70.6
2009/0120885 A1 * 5/2009 Kao ..... A47F 5/0807 211/70.6
2010/0025562 A1 * 2/2010 Shiao ..... B25H 3/04 248/682
2010/0133213 A1 * 6/2010 Kao ..... A47F 5/0807 211/70.6
2011/0042333 A1 * 2/2011 Magnusson ..... A47F 5/0846 211/70.6
2011/0056897 A1 * 3/2011 Kao ..... A47F 7/0028 211/70.6
2011/0089126 A1 * 4/2011 Hsieh ..... B25H 3/003 211/70.6
2011/0174752 A1 * 7/2011 Liao ..... A47F 5/0838 211/70.6
2011/0233160 A1 * 9/2011 Chen ..... B25H 3/06 211/70.6
2012/0061339 A1 * 3/2012 Chang ..... A47F 5/0006 211/70.6
2012/0138553 A1 * 6/2012 Kao ..... B25H 3/06 211/70.6
2012/0152871 A1 * 6/2012 Kao ..... A47F 5/0846 211/70.6
2015/0151428 A1 * 6/2015 Su ..... B25H 3/04 403/361
2017/0043475 A1 * 2/2017 Hsieh ..... B25H 3/003
2017/0049250 A1 * 2/2017 Oren ..... A47B 96/1433

* cited by examiner

TOOL HANGER

BACKGROUND OF THE INVENTION

Field of the Invention

The present invention relates to a tool hanger.

Description of the Prior Art

Generally, a connecting rod is attached to a tool hanger for storage or exhibition, and the tool hanger is disposed on the wall or exhibition board for purchase of consumers.

The conventional tool hanger includes a hanging rod and at least one slidable block, the hanging rod protrudes forward to form a rail. The rail is a post extending laterally, and a top and a bottom of the rail are provided with a top groove and a bottom groove, respectively. Each slidable block cooperates with the top groove and the bottom groove, and the top and the bottom extend backward to form an upper hooked arm and a lower hooked arm. The upper hooked aim and the lower hooked arm are left-right movable and buckled within the top groove and the bottom groove of the rail.

However, since the slidable block is slidably assembled to the rail, the slidable block is hard to be positioned on the rail and is easy to move relative to the rail. As a result, it is hard to use, and the slidable block can detach from the hanging rod.

The present invention is, therefore, arisen to obviate or at least mitigate the above mentioned disadvantages.

SUMMARY OF THE INVENTION

An object of the present invention is to provide a tool hanger movably assembled within a track slot.

To achieve the above and other objects, a tool hanger is provided, configured to be assembled to a track slot which defining a short side dimension, the tool hanger including: a base, configured to be slidably assembled within the track slot and including a wide section and at least one narrow section in a first direction, the wide section defining a first length dimension in a second direction, each narrow section defining a second length dimension in the second direction, the base further including two end portions at opposite ends of the base in the first direction, at least one of the two end portions including a resilient convex surface on the wide section and projecting toward the second direction and a compression structure corresponding to the resilient convex surface, the first direction being transverse to the second direction; a combination portion, disposed on the base; wherein the first length dimension is greater than the second length dimension and greater than the short side dimension, and the second length dimension is less than or equal to the short side dimension.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
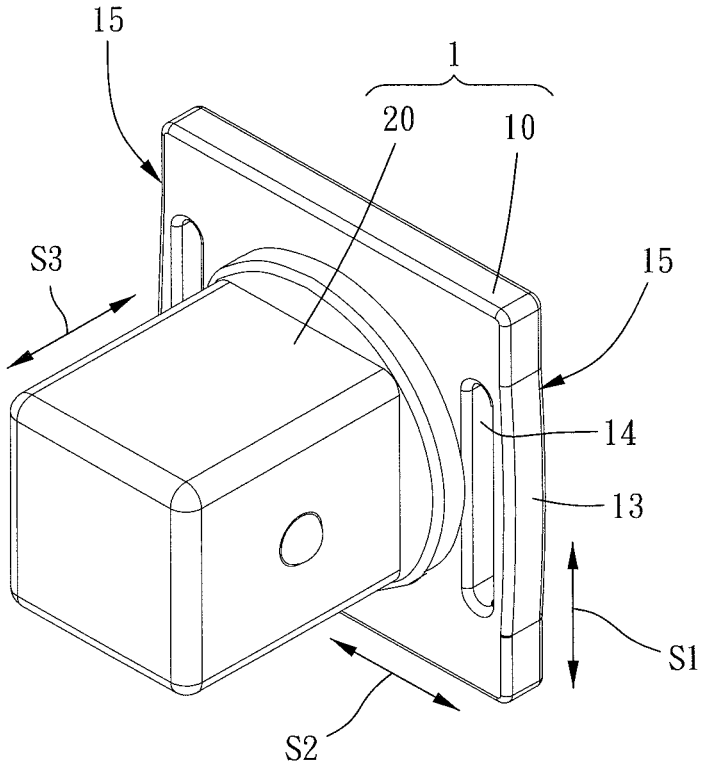
FIG. 1 is a perspective view according to a preferred embodiment of the present invention.
Figure 2:
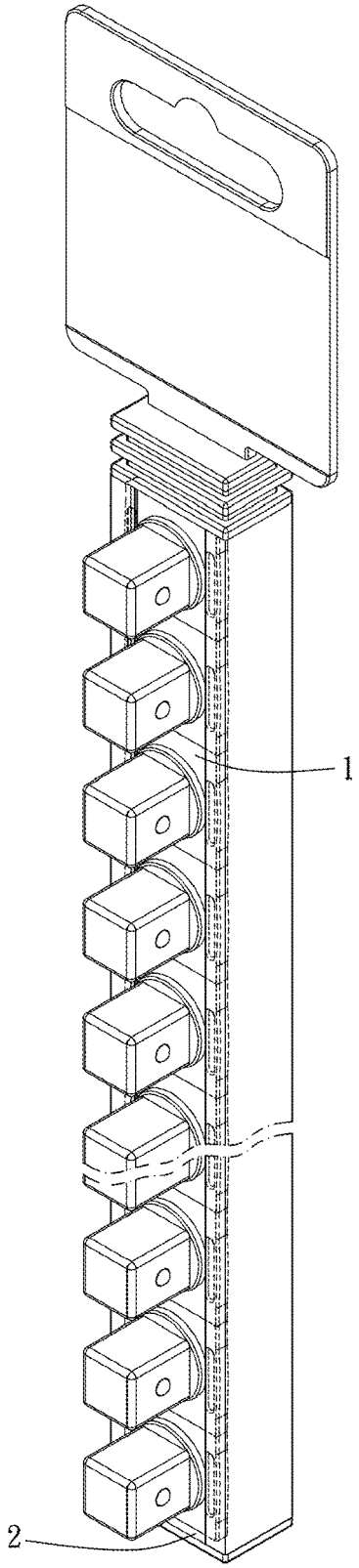
FIG. 2 is a perspective view showing a tool hanger assembled to a track slot according to a preferred embodiment of the present invention.
Figure 3:
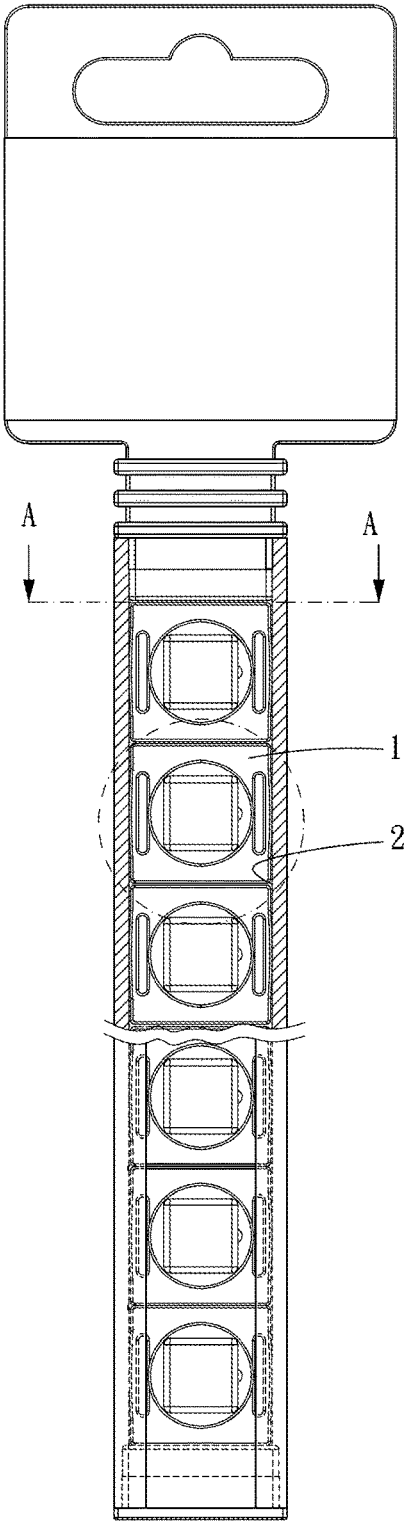
FIG. 3 is a partial cross-sectional view of FIG. 2.
Figure 4:
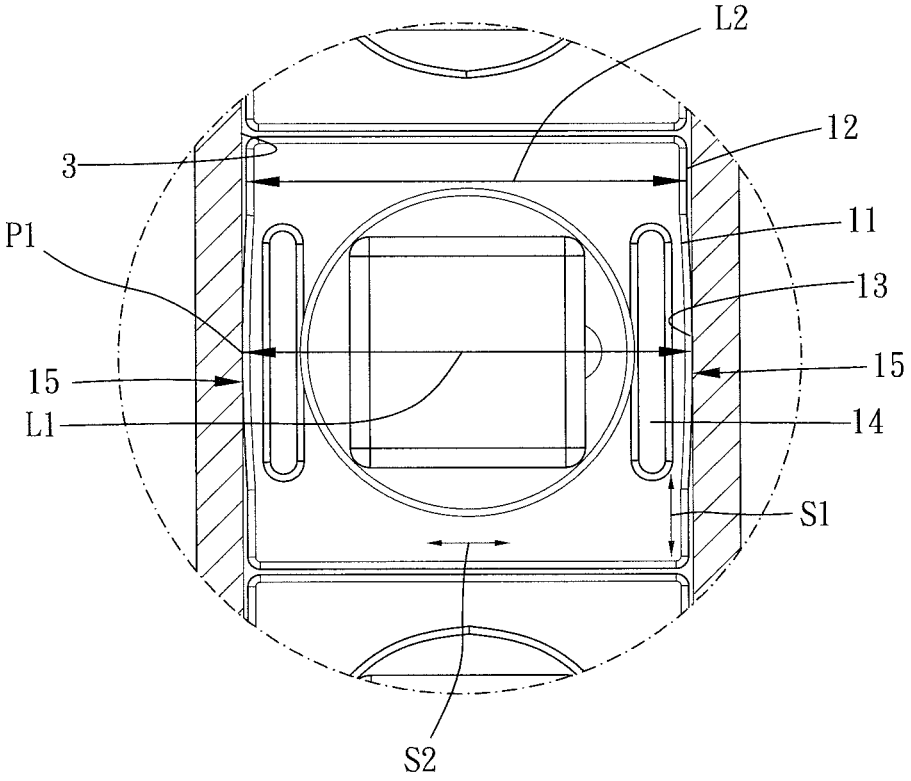
FIG. 4 is an enlarged drawing of FIG. 3.
Figure 5:
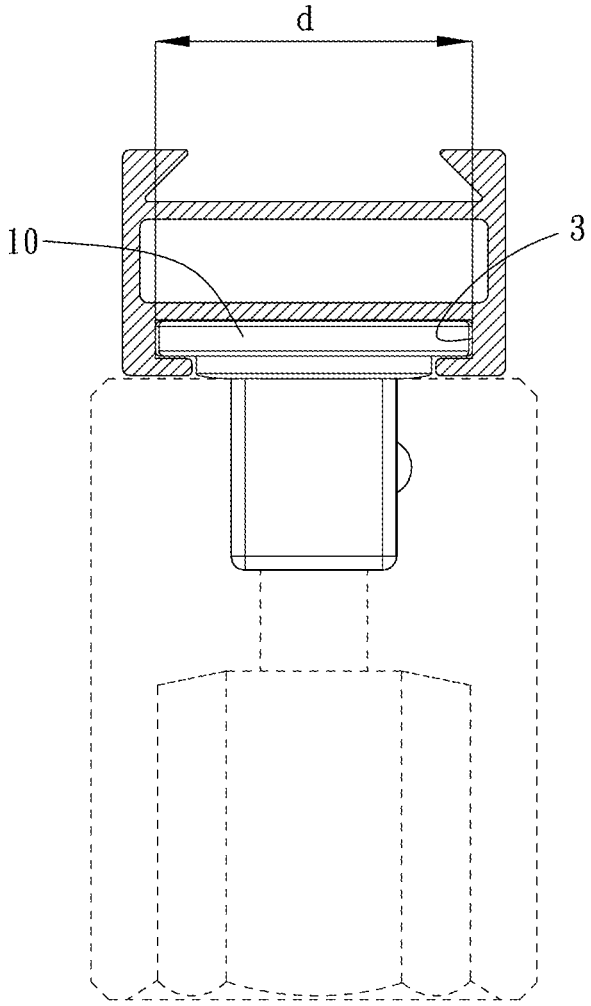
FIG. 5 is a cross-sectional view of FIG. 3, taken along the line A-A, according to a preferred embodiment of the present invention.

FIGS. 1-5 show a tool hanger according to a preferred embodiment of the present invention. The tool hanger 1 is configured to be assembled to a track slot 2, the track slot 2 defines a short side dimension d. Specifically, the track slot 2 includes two slot wall 3 disposed on opposite sides, and the short side dimension d is the interval between the two slot walls 3. The tool hanger 1 includes a base 10 and a combination portion 20.

The base 10 is configured to be slidably assembled within the track slot 2, the base 10 includes a wide section 11 and at least one narrow section 12 which are arranged in a first direction S1, the wide section 11 and at least one narrow section 12 are integrally formed of one piece, the at least one narrow section 12 is narrower than the wide section 11 in a second direction S2 from side to side, the wide section 11 defines a first length dimension L1 in a second direction, and each of the at least one narrow section 12 defines a second length dimension L2 in the second direction. The base 10 further includes two end portions 15 at opposite ends of the base 10 in the second direction S2, and at least one of the two end portions 15 includes a resilient convex surface 13 on the wide section 11 and projecting outwardly in the second direction and a compression structure 14 corresponding to and overlapping with the resilient convex surface 13 in the second direction S2, wherein the first direction S1 is transverse to the second direction. The combination portion 20 is disposed on the base 10. In this embodiment, the combination portion 20 is integrally formed as a part of the base 10, the at least one of the two end portions 15 is partially hollowed to formed the compression structure 14, as viewed in the second direction S2, the resilient convex surface 13 and the compression structure 14 are on a same plane, and the resilient convex surface 13 has an outmost point P1 of the base 10 in the second direction S2 so that the resilient convex surface 13 is resiliently and slidably abuttable against the slot wall 3 of the track slot 2. The combination portion 20 is configured to be assembled to a tool head and extends from the base 10 in a third direction S3, wherein the third direction S3 is transverse to the first and second directions S1, S2. The first length dimension L1 is greater than the second length dimension L2 and greater than the short side dimension d, the second length dimension L2 is less than or equal to the short side dimension d. Whereby, the tool hanger 1 is slidably assembled within the track slot 2 and movable toward the second direction to positionably abut against the two slot walls 3.

In this embodiment, the base 10 is shaped as a generally square body and configured to be stably inserted into the track slot 2. In other embodiment, the base may be shaped as a cylinder or polygonal body. The resilient convex surface 13 is an arched convex surface, for stable elastic deformation and tight positioning. In other embodiment, the resilient convex surface may be provided in a waved shape, toothed shape, angled shape or other polygonal shape.

The compression structure 14 is a compression space and configured for compressed deformation of the resilient convex surface 13. In other embodiment, the compression structure may be made of an elastic material having elasticity different from that of the base 10. In this embodiment, the compression structure 14 is a hole extending in a thicknesswise direction of the end portion 15, and the hole may be a blind hole. In this embodiment, the hole penetrates the end portion 15, for providing sufficient space for deformation of the resilient convex surface 13. In this embodiment, the hole is elongate oval; however, the hole may be polygonal, circular or the like. Preferably, an extent of the compression structure 14 is less than or equal to the resilient convex surface 13.

A number of the at least one narrow section 12 is two, and the wide section 11 is disposed between the two narrow sections 12 so that it is optional to insert any of the two narrow sections 12 into the track slot 2 smoothly, and the base can be stably positioned and is uneasy to displace relative the track slot 2. In other embodiment, a number of the wide section may be plural, providing multi-point abutment with the track slot.

In this embodiment, the two end portion 15, includes the resilient convex surfaces 13 on the wide section 11 extending in opposite directions and each include the compression structure 14, thus improving positioning effect. Preferably, the two end portions 15 are symmetrically arranged, thus achieving stable positioning. In other embodiment, the resilient convex surfaces of the two end portions 15 may be asymmetrically arranged.

In use, with the at least one narrow section 12 inserted into the track slot 2, the resilient convex surface 13 of the wide section 11 presses the slot wall 3 of the track slot 2 in the second direction; as the tool hanger 1 moves, the resilient convex surface 13 deforms toward the compression structure 14, thus allowing movement of the base so that the position is adjustable.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tool hanger, configured to be slidably engaged within a track slot defining a side dimension, the tool hanger including: a base, configured to be slidably assembled within the track slot and including a wide section and at least one narrow section which are arranged in a first direction, the wide section and the at least one narrow section being integrally formed of one piece, the at least one narrow section being narrower than the wide section in a second direction from side to side, the first direction being transverse to the second direction, the wide section defining a first length dimension in the second direction, each of the at least one narrow section defining a second length dimension in the second direction, the base further including two end portions at opposite ends of the base in the second direction, at least one of the two end portions including a resilient convex surface on the wide section and projecting outwardly in the second direction and a compression structure corresponding to and overlapping with the resilient convex surface in the second direction, the at least one of the two end portions being partially hollowed to formed the compression structure, as viewed in the second direction, the resilient convex surface and the compression structure being on a same plane, the resilient convex surface having an outmost point of the base in the second direction so that the resilient convex surface being resiliently and continuously slidably abuttable against a slot wall of the track slot;

a combination portion, configured to be assembled to a tool outside the track slot, extending from the base in a third direction, the third direction being transverse to the first and second directions;

wherein the first length dimension is greater than the second length dimension and greater than the side dimension which is in the second direction, and the second length dimension is less than or equal to the side dimension which is in the second direction.

2. The tool hanger of claim 1, wherein the compression structure includes a compression space.

3. The tool hanger of claim 1, wherein the compression structure includes a through hole.

4. The tool hanger of claim 1, wherein an extent of the compression structure is less than or equal to that of the resilient convex surface in the first direction.

5. The tool hanger of claim 1, wherein the base includes two of said narrow sections at two sides in the first direction, and the wide section is connected between the two said narrow sections.

6. The tool hanger of claim 1, wherein the resilient convex surface is an arched convex surface.

7. The tool hanger of claim 1, wherein the base is shaped as a generally square body.

8. The tool hanger of claim 1, wherein the resilient convex surface being configured to be entirely covered within the track slot.

9. The tool hanger of claim 1, wherein the compression structure includes a through hole which is enclosed by the wide section and the at least one narrow section.

* * * * *